United States Patent [19]

Remberg et al.

[11] Patent Number: 4,732,533

[45] Date of Patent: Mar. 22, 1988

[54] MOUNTING ARRANGEMENT FOR TURBOMACHINES, ESPECIALLY STEAM TURBINES

[75] Inventors: Axel Remberg; Detlef Haase, both of Mülheim/Ruhr, Fed. Rep. of Germany

[73] Assignee: Kraftwerk Union Aktiengesellschaft, Mülheim/Ruhr, Fed. Rep. of Germany

[21] Appl. No.: 879,131

[22] Filed: Jun. 26, 1986

[30] Foreign Application Priority Data

Jun. 27, 1985 [DE] Fed. Rep. of Germany ..... 3522917

[51] Int. Cl.[4] ..... B63B 25/14

[52] U.S. Cl. ..... 415/134; 415/219 R; 248/DIG. 1

[58] Field of Search ..... 415/134, 135, 219 R; 248/DIG. 1, 606, 638, 639, 562, 563; 403/28

[56] References Cited

U.S. PATENT DOCUMENTS

| | | | |
|---|---|---|---|
| 3,594,095 | 7/1971 | Trassel et al. | 415/134 X |
| 3,754,833 | 8/1973 | Remberg | 415/134 X |
| 4,050,660 | 9/1977 | Eggmann et al. | 415/219 R X |
| 4,456,426 | 6/1984 | Bellati | 415/134 X |

FOREIGN PATENT DOCUMENTS

| | | | |
|---|---|---|---|
| 538761 | 8/1954 | Italy | 415/134 |
| 334428 | 10/1954 | Switzerland | 415/134 |
| 546732 | 3/1977 | U.S.S.R. | 415/134 |

OTHER PUBLICATIONS

VGB Kraftwerkstechnik 59, No. 2, Feb. 1979, Illustration 9, p. 117.

VGB Kraftwerkstechnik 53, No. 12, Dec. 1973, pp. 817–826.

VGB–Kongress "Kraftwere 1982", p. 243, Illustration 14.

*Primary Examiner*—Robert E. Garrett

*Assistant Examiner*—Joseph M. Pitko

*Attorney, Agent, or Firm*—Herbert L. Lerner; Laurence A. Greenberg

[57] ABSTRACT

Mounting arrangement for turbomachines, especially steam turbines having a plurality of coaxially juxtaposed turbine states with shafts rigidly coupled to one another to form a shaft line, includes respective step-shaped projections formed on support lugs of turbine stage housings and jutting axially outwardly and with a step-shaped upwardly offset setback axially inwardly adjacent the projections while forming a horizontal bottom surface serving as a support and guide surface; the respective mount housing having support flanges gripping under the support lugs at both sides of the shaft in accordance with the position of the support lugs, the support flanges having a depression for accommodating therein the stepshaped projection and having a step-shaped raised rim axially adjacent the stepshaped projection for engaging in the setback of the support lug; mutual engagement of the projection in the depression, and the raised rim in the setback providing clearance sufficient to form laterally accessible gaps; adjustment and slide shims insertable in the gap between a roof surface of the raised rim and a bottom surface of the setback for the purpose of slidable height positioning, the shims being securable in position thereof; the support lugs being secured against lifting forces and moments in a set height position by means of locks detachably fastened to a cover surface of the support flanges and engaging the stepshaped projections of the support lugs by means of lock projections having contact surfaces which are adjustable in height.

12 Claims, 11 Drawing Figures

MOUNTING ARRANGEMENT FOR TURBOMACHINES, ESPECIALLY STEAM TURBINES

The invention relates to a mounting arrangement for turbomachines, especially steam turbines having several coaxially juxtaposed turbine stages with shafts which are rigidly coupled to one another to form a line of shafts.

A mounting principle of housings or housing parts of turbine stages is illustrated for an inner housing in the journal VGB Kraftwerkstechnik 59, No. 2 of February 1979, namely in Rig. 9 on page 117 thereof; it is explained in a similar manner in the Volume VGB Congress "Kraftwerke 1982" on page 243 in FIG. 14 in conjunction with the associated text. The application if the mounting principle to the entire shaft line of a turboset with several housings is explained in greater detail in VGB Kraftwerkstechnik 53, No. 12, December 1973, pages 817 to 826 especially on page 820 with FIG. 11. There, the starting point is a turbine mounting arrangement in which mount housings, called bearing blocks therein, are stationary so that supporting and guiding surfaces of the turbine stage housings as well as guide surfaces thereof for axial centering can slide relative to these fixed reference surfaces of the mount housings or other foundation parts of the turbine stage housings in an axially and radially-centric thermally movable manner, the axial motion in an axial-normal reference plane i.e. a reference plane normal to the axis, which serves as an axial fixed point, being omitted, of course.

A particular problem inherent in a mounting arrangement of the type described hereinbefore is to assure, despite a fixed mount housing or other foundation reference surfaces, a precise axially and radially-centric thermally movable sliding motion of the support lugs or other guide surfaces of the housings; to ensure an externally accessible adjustability of the mounting and the guiding engagement in the x, y and z directions; and to make the mounting variable, i.e. the mounting arrangement should be so constructed that, without great variations, it is possible to realize selectably therewith a possibility of axial sliding or an axial fixed point.

It is an object of the invention to provide a mounting arrangement for turbomachines of the foregoing general type, by means of which it is possible, in the sense of the problem stated, to assure, when mount housing or other foundation reference surfaces are stationary, an adjustable, axially and radially-centric thermally movable mounting of support lugs and guide surfaces of turbine stage housings on associated bearing and contact surfaces of the mount housings, with sufficiently large sliding surfaces; to be able to form axially sliding or axially fixed bearing or mounting points, selectably; and to be able to insert, and possibly exchange adjustment and slide shims in appropriate seating spaces of the mounting arrangement with ready accessibility from the outside, thereby making the mounting arrangement particularly easy to assemble and service.

With the foregoing and other objects in view, there is provided, in accordance with the invention, a mounting arrangement for turbomachines, especially steam turbines having a plurality of coaxially juxtaposed turbine stages with shafts rigidly coupled to one another to form a shaft line, the turbine stages having turbine mounts including turbine shaft mounts and turbine housing mounts, the turbine mounts having respective mount housings mounted on foundation locks between the turbine states and at the ends of the shaft line, the turbine stages having housings mounted at the ends thereof by means of support lugs symmetrically on both sides of the shaft so as to be axially and radially-centrically thermally movable as well as adjustable in x, y, and z direction in horizontal axial planes, and by means of axial centering guiding means in vertical axial planes, on and along the mount housings, respectively, or other foundation parts, the support lugs having support and guide surfaces and the axial centering means having guide surfaces extending in horizontal axial planes (x-z) and in vertical planes oriented plane-parallel to the vertical axial plane (x-y) and, for defining axial fixed points of thermal expansion of the housings, in planes (y-z) normal to the axis, respectively, the direction x being the axial shaft direction, z the horizontal direction transverse to the axis, and y the vertical coordinate running perpendicularly to the x-z plane, includes respective step-shaped projections formed on the support lugs of the turbine stage housings and jutting axially outwardly and with a step-shaped upwardly offset setback axially inwardly adjacent the projections while forming a horizontal bottom surface serving as a support and guide surface; the respective mount housing having support flanges gripping under the support lugs at both sides of the shaft in accordance with the position of the support lugs, the support flanges having a depression for accommodating therein the stepshaped projection and having a stepshaped raised rim axially adjacent the stepshaped projection for engaging in the setback of the support lug; mutual engagement of the projection in the depression, and the raised rim in the setback providing clearance sufficient to form laterally accessible gaps; adjustment and slide shims insertable in the gap between a roof surface of the raised rim and a bottom surface of the setback for the purpose of slidable height positioning, the shims being securable in position thereof; the support lugs being secured against lifting forces and moments in a set height position by means of locks detachably fastened to a cover surface of the support flanges and engaging the stepshaped projections of the support lugs by means of lock projections having contact surfaces which are adjustable in height.

In accordance with another feature of the invention, the bottom surface of the setback, and the cover surface of axial projection of the respective support lug are disposed in the same horizontal plane (x-z) and are adjustable to the level of the horizontal axial plane of the turbomachine by means of the adjustment and slide shims, and including sliding blocks secured in position thereof and bridging another gap, the sliding blocks being received in the gap between the underside of the respective lock projection and the cover surface of the axial projection.

In accordance with a further feature of the invention, there are provided, setscrews passing through the lock projections and screwed from above into a blind tapped hole formed in the sliding blocks, set setscrews being secured against being unscrewed so as to secure the sliding blocks in position thereof.

In accordance with an additional feature of the invention, to define an axial, thermal-expansion fixed point in vicinity of the housing end of a turbine stage, slide and adjustment shims in the form of Woodruff keys are insertable from the side and securable in position thereof in the gaps formed between sides of the raised rim of the respective support flange, the sides pointing in the directions +x and −x, on the one hand, and the side surfaces of the setback of the respective support lug which are opposite thereto, on the other hand.

In accordance with an added feature of the invention, a single mount has two support lugs individually resting on a respective support flange of the mount housing on both sides of the shaft center.

In accordance with yet another feature of the invention, the single mount is disposed at the outer end of a turbine stage, and the axial gaps are vacant so as to afford an axial sliding motion of the housing end.

In accordance with yet a further feature of the invention, there is provided, a double mount with four support lugs resting in pairs on both sides of the shaft center on a respective double flange of the mount housing, the support lug pair resting on the one axial end of the two double flanges belonging to the housing of the one turbine stage, and the support lug pair resting on the other axial end of the two double flanges belonging to the housing of the axially adjacent turbine stage.

In accordance with yet an additional feature of the invention, the double mount serves to define the axial heat expansion fixed points of the two turbine stage housings resting thereon and serves to accommodate a thrust bearing defining the axial shaft fixed point.

In accordance with yet an added feature of the invention, with high-pressure, medium-pressure and at least one low-pressure turbine stage of an associated steam turbine, the double mount defining the axial heat expansion fixed point being disposed between the high-pressure turbine stage and the medium-pressure turbine stage.

In accordance with an alternate feature of the invention, the locks securing the support lugs against lifting forces are held against the respective support flange by strong anchor bolts.

In accordance with again another mode of the invention, for centered guidance of the turbine stage housings in the vertical axial plane (x-y), axially projecting, rectangular guide spurs are disposed below the turbine shaft at the end of a mount housing base plate facing towards the end face of the turbine stage, the guide spurs engaging a rectangular cutout formed in guiding forks at the turbine end face, leaving gaps at the sides and end face thereof, the gaps at the sides being filled out by fitting parts secured in position thereof and serving to provide alignment in shaft axial direction.

In accordance with a concomitant feature of the invention, measuring marks or indicators are fastened to the axially projecting projection of the support lugs and, in association therewith, a scale for reading the housing expansion in z direction, the scale being fastened in the margin area of the support flange. The advantages achievable with the invention are seen in particular in that a rugged mounting arrangement with large sliding surfaces has been creased, making the coupling of the turbine stage housings to the mount housings with their support lugs can be lowered from above onto the supporting flanges of the mount housings, the exact height alignment being made from the side i.e. quite accessibly, by inserting the adjustment and slide shims. Correspondingly simple is the alignment in axial direction and the formation of the fixed axial point by the insertion of appropriate adjustment and slide shims, after which the locks to secure the support lugs against lifting forces and moments are mounted to the cover surface of the supporting flanges. Besides good accessibility of the adjustment and slide shims (adjusting elements), the advantageous introduction of forces over large force introduction cross sections must be noted, as well as the possibility of providing measuring marks. Harmoniously integrated in the mounting and adjusting system are the centering guiding means.

Assuming that the cover surface of the support flanges define the horizontal axial plane for the mounting, matching the support lug mounting to this reference plane is possible in a relatively simple manner, the height adjustment of the support lugs, once made, being secured by the locks and by special adjusting means on these locks in the form of sliding blocks while making possible a sliding clearance. The locks are held against the support flange by means of strong anchor bolts secured against twisting or unscrewing, thus, in turn, securing the support lugs against being lifted off. The construction of the mounting arrangement selectably as an axial fixed point or as an axial sliding seat as well as other possible variations of the mounting arrangement is effected through the provision thereof as a single mount or else as a double mount.

Other features which are considered as characteristic for the invention are set forth in the appended claims.

Although the invention is illustrated and described herein as embodied in mounting arrangement for turbomachines, especially steam turbines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which: FIGS. 1, 2, 6 and 7–10 depict the subdivisions of the respective figures.

Figure 2:
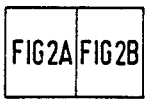
FIGS. 2A and 2B are respective fragmentary plan views of FIGS. 1A and 1B showing one-half of the turboset located on one side of the shaft center line thereof.
Figure 2A:
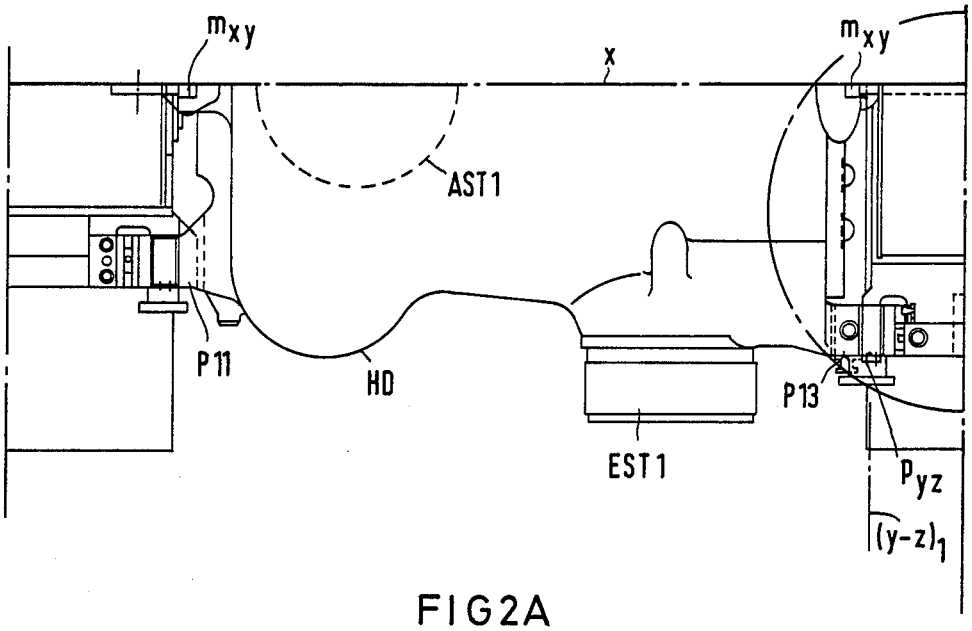
Figure 2B:
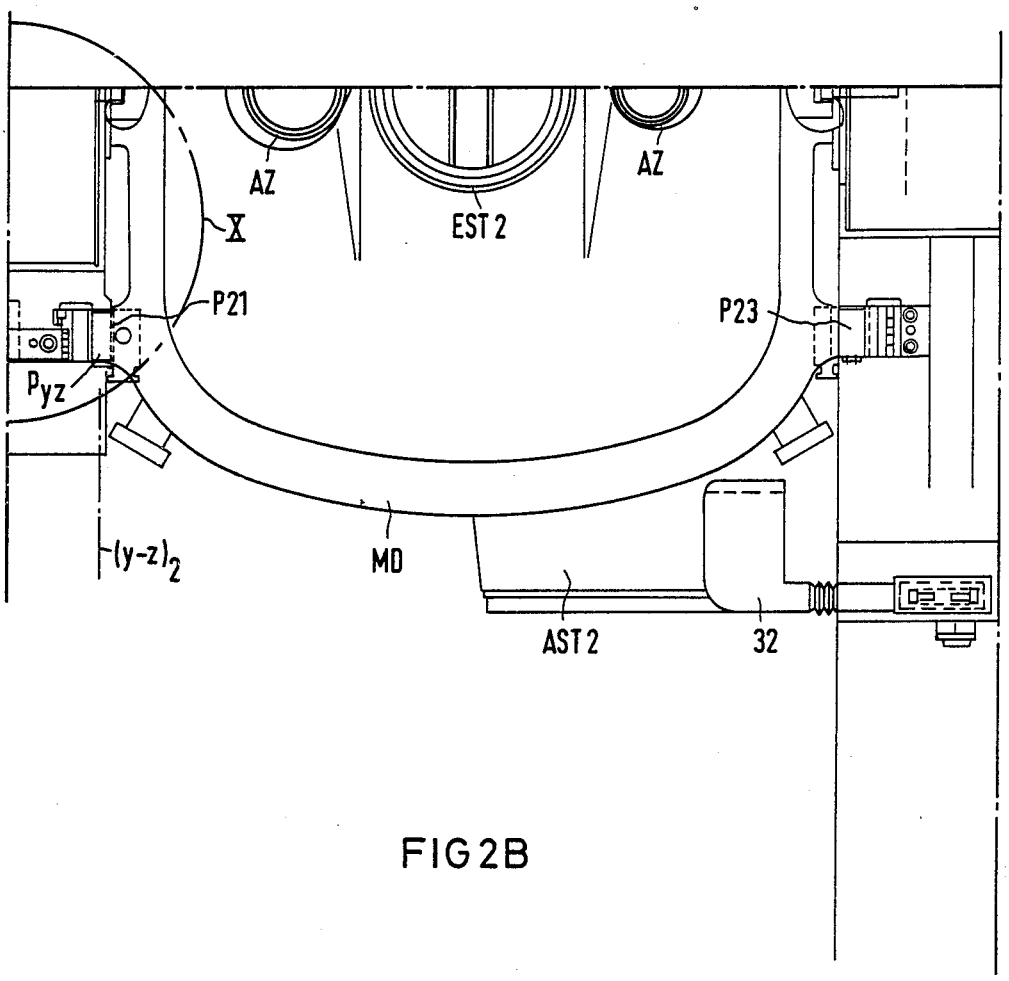
Figure 10A:
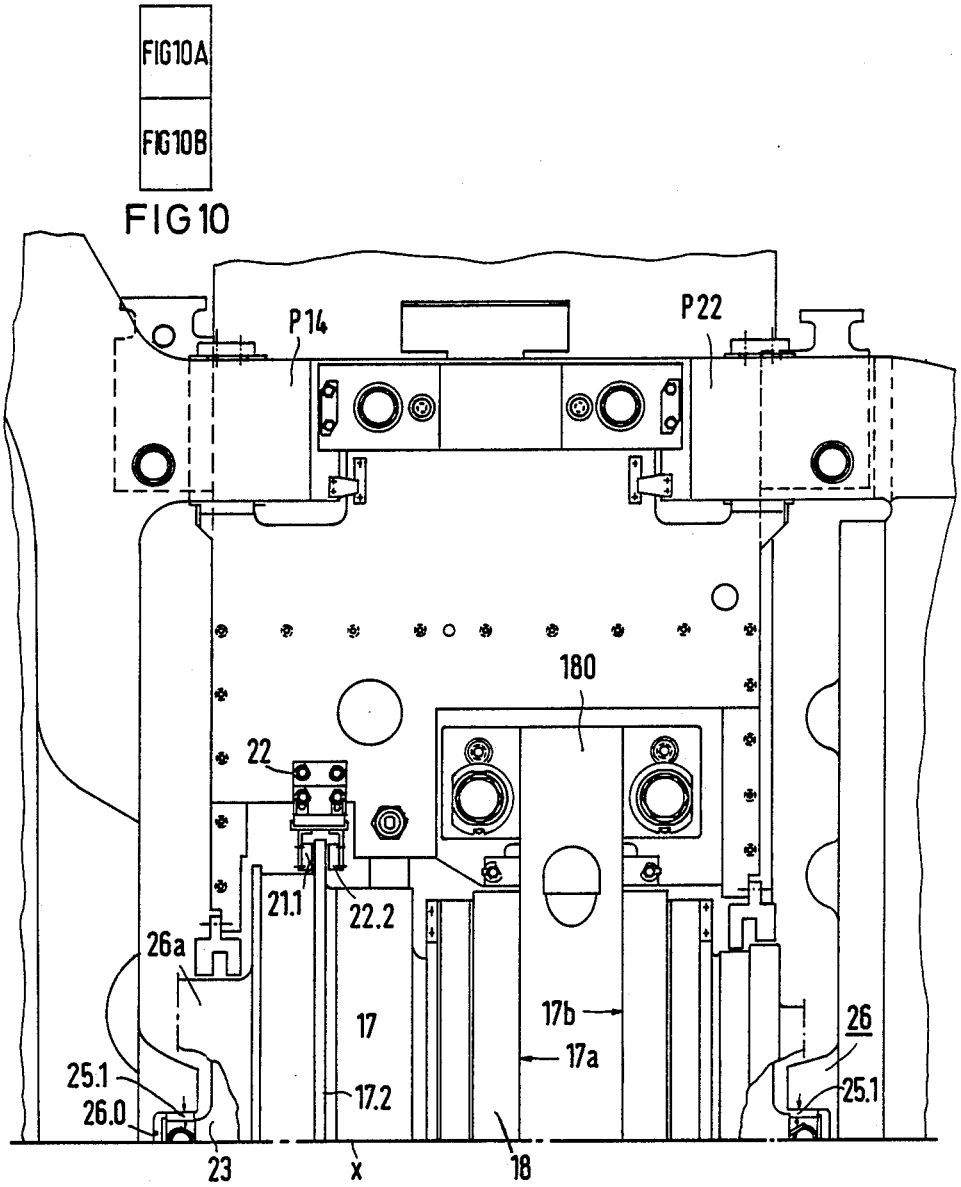
Figure 10B:
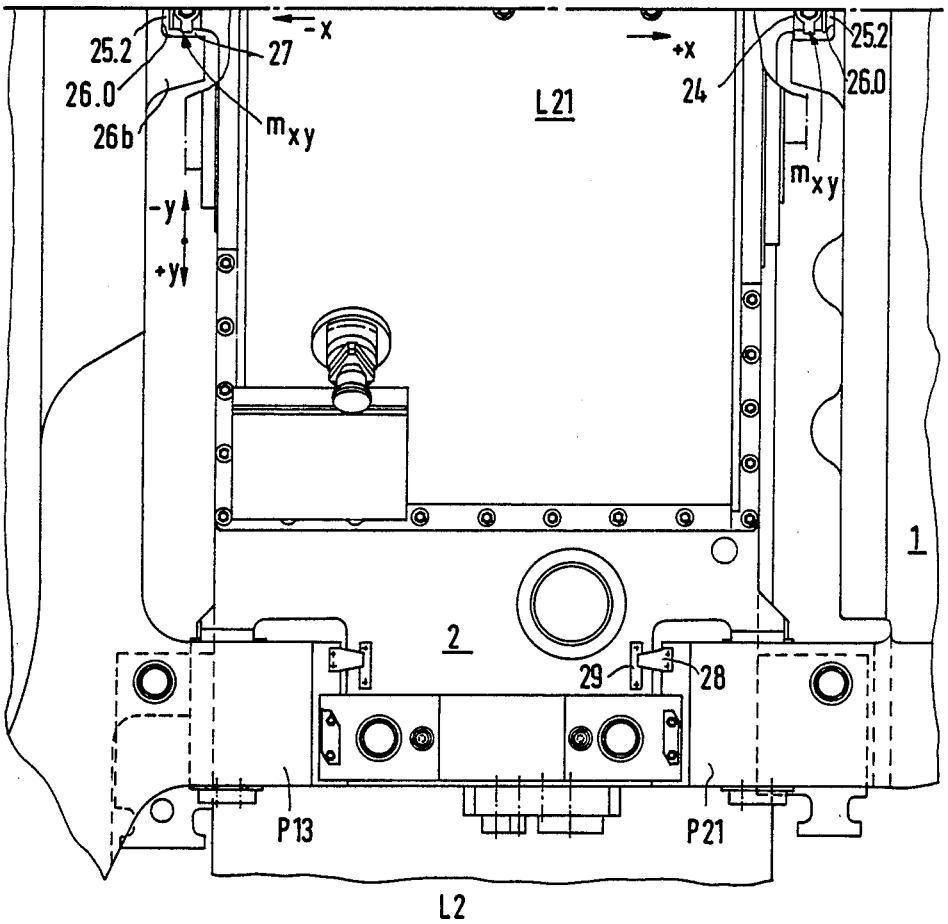
Figure 11:
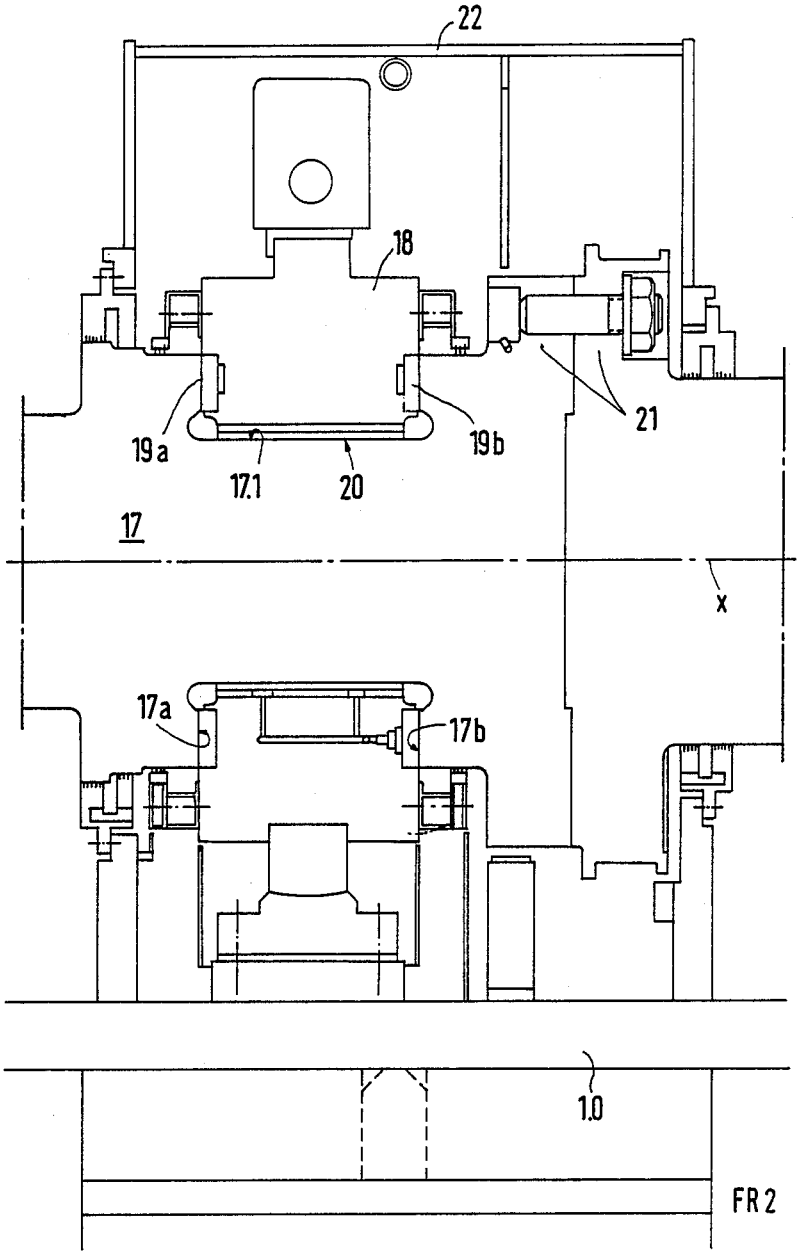

FIGS. 10A and 10B are enlarged fragmentary views of FIGS. 2A and 2B showing the encircled detail X supplemented by a plan view of the turbine mount half located between the high-pressure and the medium-pressure turbine stages which was omitted from FIGS. 2A and 2B, the turbine mount being shown partly uncovered, and parts of the axial mounting of the turbine shaft as well as the mounting elements of the housing centering means being visible; and FIG. 11 is a reduced fragmentary elevational view, partly in section, of the mounting of FIGS. 10A and 10B.

Figure 1A:
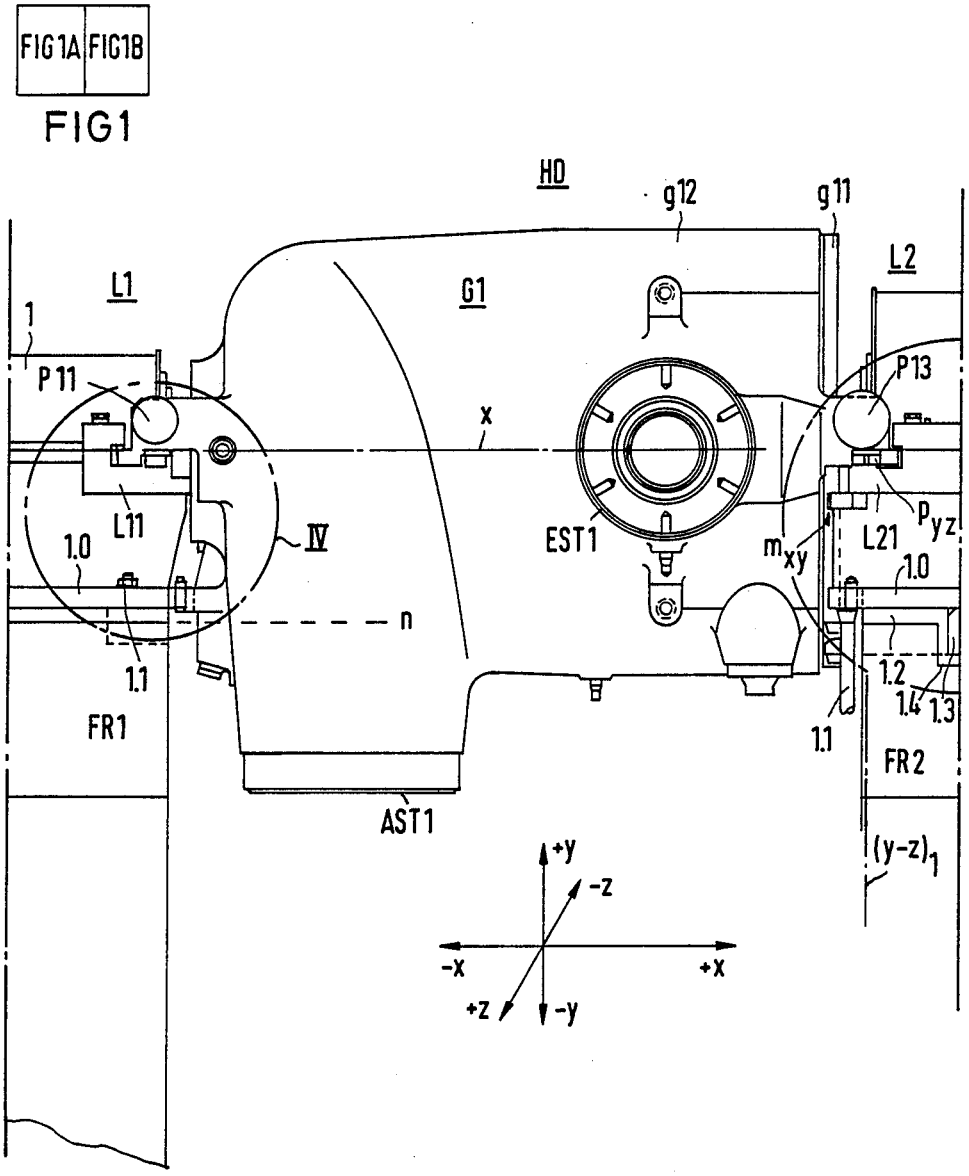
FIGS. 1A and 1B are respective left-hand and right-hand side elevational views of a turboset of which only the high-pressure and medium pressure turbine stages and the thereto appertaining mounts constructed in accordance with the invention are shown.
Figure 1B:
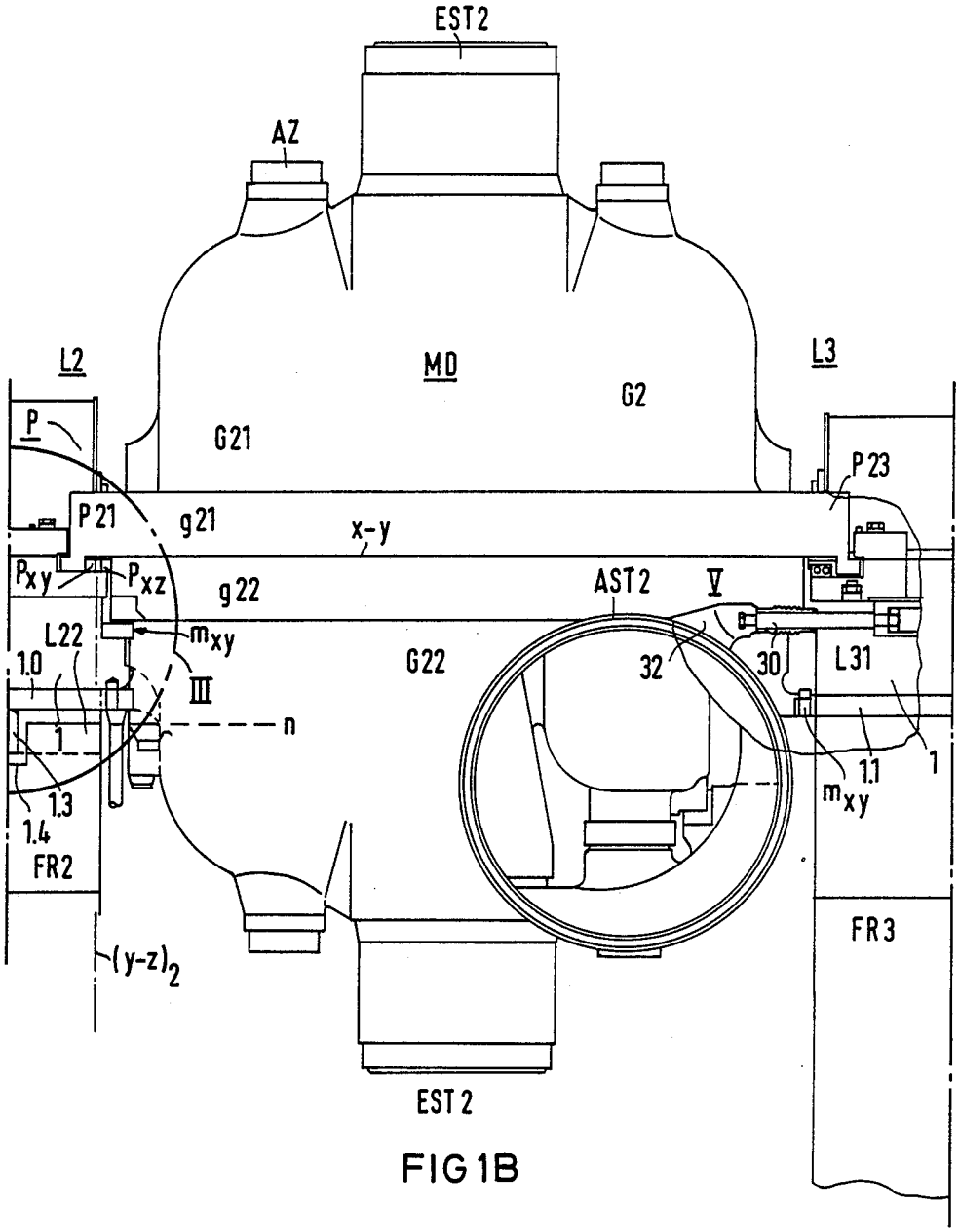

Referring now to the drawing and, first, particularly to FIGS. 1A, 1B, 2A and 2B thereof, there are shown therein the outer housing contours of a high-pressure turbine stage HD and of a medium-pressure turbine stage MD disposed coaxially to one another in the direction of a shaft center line x. The turboset, shown in section in FIGS. 1A, 1B, 2A and 2B, has two different embodiments of the mounting arrangement according to the invention for turbine mounts L1, L2 and L3 thereof. Shown are mutually coaxial housings G1 and G2 of a high-pressure turbine stage HD and of a medium-pressure turbine stage MD. Adjacent to the right end of the latter stage MD, as shown in FIG. 1B, is the turbine mount L3, followed coaxially by one or more low-pressure turbine stages not shown because this is unnecessary for an understanding of the invention, even though in principle, the inner and/or outer housing of the low-pressure turbine stages could be equipped with mount types L1, L2 or L3 according to the invention.

The turbine shafts, the shaft couplings and the shaft bearings are not detailed in FIGS. 1A, 1B, 2A and 2B, nor are the incoming and outgoing steam line (only pipe unions are shown) and the blading inside the turbine stages HD and MD. The coaxial shafts of the turbine stages, which are not shown in FIGS. 1A, 1B, 2A and 2B, are rigidly coupled to one another so as to form a through shaft which, apart from the detailed representation in FIGS. 10A, 10B and 11, is indicated only by shaft center line x shown as a dot-dash line. The turbine mounts L1 at the outer end of the high-pressure turbine stage HD, L2 between the two turbine stages HD and MD, and L3 at the outer end of the medium-pressure turbine stage MD are mounted on and fastened, coaxially to the housing G1 and G2 of the turbine stages HD and MD and coaxially to the through shaft x, to foundation locks FR1, FR2 and FR3 of an otherwise non-illustrated turbine foundation. Such foundation locks are usually formed by the webs remaining between cutouts in a horizontal steel or prestressed concrete slab, lower housing halves of the turbine stages projecting through these cutouts, and the slab supporting the entire turboset being supported via foundation pilings by a base plate resting on the building foundation, as shown, for example, in FIGS. 1 and 3 of the article "Deformation Behavior of Turbine Foundations", Journal VGB Kraftwerkstechnik 59, No. 10 of October 1979, pages 819 to 833.

The upper bearing surfaces of the foundation locks lie on the level n indicated by a broken line; on these, by means of bottom plates 1.0 of mount housings (generally identified by reference character 1) of the turbine mounts L1, L2 and L3 are the mount housings disposed, height-adjusted by means of otherwise non-illustrated thrust screws in these bottom plates 1.0 and aligned in the axis direction x; and secured against being lifted off after alignment by means of anchor bolts 1.1 (shown somewhat in greater detail only at the middle turbine mount L2); and encased in concrete 1.2 in situ, the concrete filling the gap between the bottom plate 1.0 and a downwardly directed rib 1.3 on the bottom plate, on the one hand, as well as the upper edge n of respective bearing surfaces of the foundation lock and a rectangular cutout 1.4 accommodating the rib 1.3, on the other hand. The foundation locks FR1, FR2 and FR3 may generally involve foundation trusses which need not necessarily be disposed on a foundation slab; it is important only that aligned, horizontal levels n to support the bearing or mounting housings 1 be provided. The high-pressure turbine stage HD has a pot-type housing G1 augmented by four support lugs, only two of which, namely P11 and P13, are shown in FIGS. 1A, 1B, 2A and 2B, the other two non-illustrated support lugs P12 and P14 should be imagined to be arranged opposite the support lugs P11 and P13, respectively, mirror-symmetrically to the shaft center line x. The support lug P14 is shown, incidentally, in FIG. 10A. The housing G1 of the high-pressure turbine stage HD, furthermore, has two formed or welded-on intake nipples or unions which are disposed mutually opposite one another on the same axis, one of which the intake unions EST1 being visible in FIGS. 1A and 2A. Also visible is a discharge union or nipple AST1 pointing downwardly at the discharge end in FIG. 1A.

The medium-pressure turbine stage MD has a housing G2 which, in the horizontal axial plane x-z, is divided into an upper housing part G21 and a lower housing part G22, housing flanges g21 and g22 thereof being joined to one another steamtightly in the horizontal axial plane x-z (the flange screws are omitted in the interest of simplicity). Analogous to the high-pressure turbine stage HD, formed on the flange g21 of the upper housing half G21 are four support lugs which lie symmetrical to the vertical axial plane x-y, only the support lugs P21 and P23 thereof being visible in FIGS. 1B and 2B. Of the other two support lugs P22 and P24 located opposite the lugs P21 and P23, only the support lug P22 is visible in FIG. 10A. Associated with the upper and lower housing parts G21 and G22 of the medium pressure turbine stage MD are a respective inlet union EST2, which are directed upwardly and downwardly, respectively; a double flow medium-pressure turbine stage with central intake is involved (single-flow design is also possible), there being provided in axial direction, adjacent to the two inlet unions EST2, two bleed steam nipples or unions AZ, respectively. In addition, the lower housing part G22 has two discharge unions or nipples AST2 which are disposed opposite one another on the same axis and are oriented in a direction transverse to the axis.

With the mounting arrangement according to FIGS. 1A, 1B, 2A and 2B, the mounting principle known in turbo machines of mounting the housings G1 and G2 of the turbine stages HD and MD at the housing ends thereof by means of the support lugs P11 to P14 and P21 to P24, respectively, symmetrically on both sides of the shaft x in horizontal axial planes x-z on the mounting housings 1 (or other foundation parts) so as to be axially and radially centrally thermally movable as well as adjustable in x, y and z directions is realized. To this thermally movable mounting with adjustment possibility there also belongs the axial centering or central guidance in the vertical axis plane x-y. The support and guide surface $P_{xz}$ on the support lugs generally identified by the reference character P extend in horizontal axial planes (x-z) while the support and guide surfaces $m_{xy}$ for axial centering extend along housing forks or spurs, as is explained hereinafter, in vertical axial planes, plane-parallel to the vertical axial plane x-y, and the support and guide surfaces on the support lugs P for determining fixed axial points of thermal housing expansion extend in axial-normal planes y-z and are generally identified by reference character $P_{yz}$ and provided at the middle turbine mount L2 in the embodiment according to FIGS. 1A, 1B, 2A and 2B. The two axial-normal planes going through the center of the axially fixed support lugs P13, P14 and P21, respectively, are marked $(y\text{-}z)_1$ and $(y\text{-}z)_2$ in FIGS. 1A, 1B, 2A and 2B. It follows from the foregoing that cartesian coordinates (note the coordinate systems in FIGS. 1A and 3) are being used for defining the support and guide or slide planes, x representing the direction of the shaft axis, z generally the horizontal direction traverse to the axial and y generally the vertical coordinate perpendicular to the x-z plane. As far as the housing mounting function is concerned, the mount housing 1 of the turbine mounts L1 and L3 are of identical construction; all of them have a bottom or anchor plate 1.0 which rests on the respective foundation lock FR and is anchored to it. Furthermore, all of the mount housings 1 have a cover plate 1.5 with support flanges, generally identified by reference numeral 2, which extend beyond the clamping range of the mutually opposing support flanges P11–P12, P13–P14, and so forth and which, in particular, are marked 2+ if oriented in the +x direction and if they extend in this direction, respectively, but are marked 2− if they extend in the opposite and −x direction. The mount hosings 1 are of welded steel construction, and the correspondingly strongly constructed bottom or anchor plates 1.0 and cover, respectively, thereof plates 1.5, are spaced from one another in elevational direction y by means of end walls 1.6 and side walls 1.7 and joined together to form a strong box constructions, the anchor plate 1.0 having overhangs and flanges, respectively, to attach anchor bolts 1.1, the latter being anchored in appropriate non-illustrated abutment plates which extend through cutouts formed in the foundation locks.

To explain the invention more clearly, the turbine mount L2 (FIG. 3) and the detail or fragmentary view of FIGS. 6A, 6B, 7A, 7B, 8 and 9 will be discussed first. It is evident from FIG. 3 in conjunction with FIGS. 6A and 6B that the support lugs P of the turbine stage housing G1 and G2 are, respectively, equipped with an axially outwardly jutting step-shaped projection 3 and, adjacent thereto an axially inwardly, upwardly stepped setback 4. This setback 4 has a horizontal bottom surface 4.1 which serves as support and guide surface $P_{xz}$ for the support lug P and the associated turbine housing, respectively. By describing the setback 4 as being adjacent and axially inwardly stepped, there is meant that, in relation to the projection 3, the setback 4 is axially adjacent in the direction towards the turbine interior.

Depending upon the location of the support lugs P, the aforementioned support flanges 2, especially 2− and 2+, of the appertaining mount housing 1 grip or engage under the support lugs P on both sides of the shaft x. For this purpose, the support flanges 2 are respectively formed with a depression 5 to accommodate the stepped projection 3 and, axially adjacent thereto, are formed with a rim 6 a raised in stepped fashion to engage the setback 4 of the support lug P.

The mutual engagement of the stepped projection 3 in the depression 5 and of the raised rim 6 in the setback 4 is provided with enough clearance to form gaps generally identified by reference numeral 7 which are accessible from the side. Apart from unavoidable tolerances, these gaps 7 are bounded by mutually plane-parallel, opposing boundary surfaces because the projection 3 and the setback 4, on the one hand, and the depression 5 and the raised rim 6, on the other hand, have rectangular cross sections.

Figure 8:
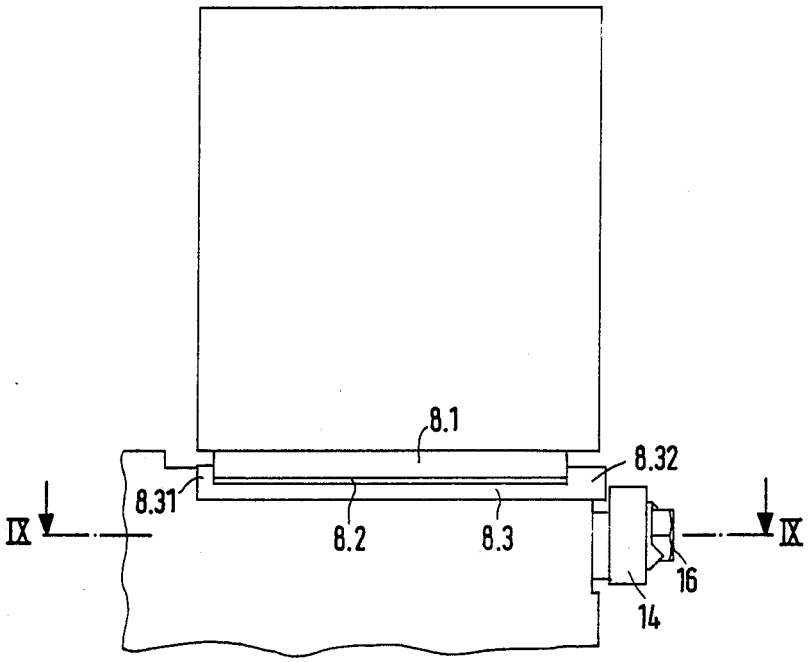
FIG. 8 is a sectional view of FIG. 6A taken along the line VIII—VIII.

For this purpose of slidable height positioning, there are inserted into the gap 7.1 between the roof surface 6.1 of the raised rim 6 and the bottom surface 4.1 of the setback 4, adjustment and slide shims 8 which are secured in the position thereof and are insertable in this gap 7.1 during the assembly of the turboset and securable in the inserted position thereof, respectively. In particular, these adjustment and slide shims 8 are dimensioned so that the bottom surface 4.1 of the support lug P is aligned exactly with the level of the horizontal axial plane x-z (identical with the horizontal parting line of the turbine housing G2). The adjustment and slide shims are formed, in particular of several layers, as FIG. 8 shows more explicitly, namely of the sliding metal layer 8.1 and of sheet steel shims 8.2 underlay located therebeneath and serving to provide exact height adjustment, and of a lower layer in the form of a steel shoe 8.3 which with lateral, angular extensions 8.31, 8.32 thereof grippingly overlaps the side surface of the sliding metal shim 8.1 and of the shim 8.2, thus securing them against shifting transversely to the axis (shifting in axial direction cannot occur because axial check or fixing points are formed in the mount L2.

The support lugs P (and this applied to all support lugs P i.e. also those of the turbine mounts L1 and L3) are secured in a set height or elevational position thereof according to FIG. 6 against lifting forces and moments by locks 9 which are releasably fastened to the cover surface 2.1 of the support flanges 2 and which have lock projections 9.2, which are adjustable in height as to the contact surfaces 9.1 thereof, and grippingly overlap the stepped projections 3 of the support lugs P, namely the cover surface 3.1 thereof.

Figure 7:
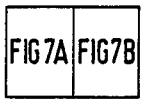
FIGS. 7A and 7B are sectional views of FIGS. 6A and 6B taken along the line VII—VII.

As has been explained hereinbefore, it is expedient for the bottom surface 4.1 of the setback 4 and also the cover surface 3.1 of the axial projection 3 of the support lug P to lie in the same horizontal plane x-z and to be adjustable to the level of the horizontal axial plane x-z of the turbo machine by means of the adjustment and slide shims 8. To be able to fix this adjusted position of the support lugs while maintaining a slight slide clearance in a defined manner, there are inserted or insertable during assembly, in the gap 7.2 between the underside of the respective lock projection 9.2 and the cover surface 3.1 of the axial projection 3, sliding blocks 10 which bridge the gap 7.2 and are secured in the position thereof. To secure the position of these sliding blocks 10, setscrews 11, penetrating the lock projections 9.2, are expendiently screwed from above into a blind tapped hole 10.1 formed in the sliding blocks and secured against rotation in the screwed-in position thereof (note the antirotation lock 11.1 at the head of screw 11) The screw 11 penetrate the locks in appropriate holes 11.2; they can be seen from the top in the right-hand part of FIG. 7 and are assigned in pairs to the respective lock projection 9.2 with the respective sliding blocks 10.

Figure 9:
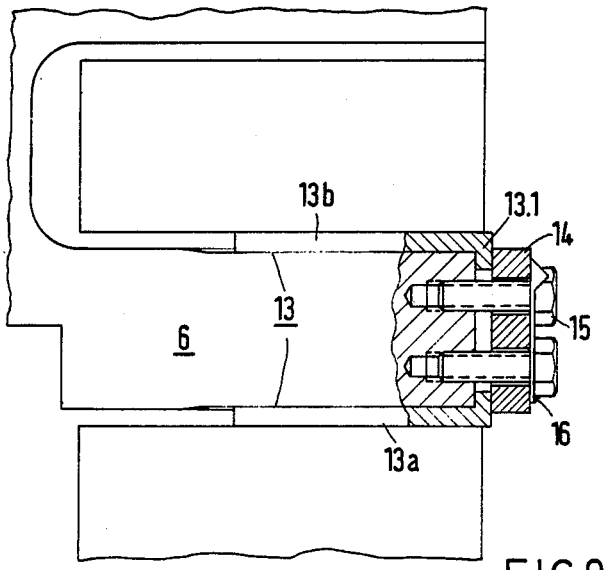
FIG. 9 is a sectional view of FIG. 8 taken along the line IX—IX.

The locks 9, securing the support lugs P against being lifted, are themselves ruggedly constructed with a thickness of from 20 to 30 mm and held against the support flange 2 by correspondingly strong anchor blots 12 screwed into blind tapped holes 2.2 formed in the support flange 2. What are involved are expansion bolts with strong heads 12.1 and a thread 12.2 at the lower end thereof, such as of the size M52 corresponding to 52 mm. The locks 9 are thus held against the cover surface 2.1 under preload of the expansion bolts 12 and cannot loosen due to vibrations during operation. As indicated hereinbefore in connection with FIGS. 1 and 2, the middle turbine mount L2 serves to determine or define an axial heat expansion fixed point, to define corresponding fixed point planes $(y\text{-}z)_1$ and $(y\text{-}z)_2$ going through the fixed points, respectively. For this purpose, there are inserted in the two gaps 7.3*a* and 7.3*b* formed between the legs 6.2 and 6.3 of the raised rim 6 of the support flange 2 pointing in +x and −x direction, one the one hand, and the side surfaces 4.2 of the setback 4 of the support lug P, the side surfaces being opposite the legs 6.2 and 6.3, on the other hand, slide and adjustment shims in the form of woodruff keys 13 or 13*a*, 13*b* which are secured in the position thereof and are insertable and securable during assembly, respectively. The sectioned view of FIG. 9 shows the location of the woodruff keys 13*a*, 13*b* having outer, angular projections 13 which encompass the raised rim 6 of the support flange 2 and which are secured in the illustrated inserted position thereof by a cover plate 14, the fastening screws 15 of this cover plate 14, screwed from the side into appropriate blind tapped holes in the raised rim 6, being fixed in their screwed-in position by means of an antirotation lock 16. The latter, like the antirotation lock 11.1 for the screws 11, is constructed as a sheetmetal antirotation lock with tabs which can be bent upwardly. At the same time, the cover plate 14 secures the shoe 8.3 of the adjustment and slide shim arrangement 8 in position thereof in the lateral direction z, as shown in detail in FIG. 8. The side surfaces 4.2 correspond to the support and guide surfaces from FIG. 2 generally identified by reference character $P_{yz}$.

Figure 6A:
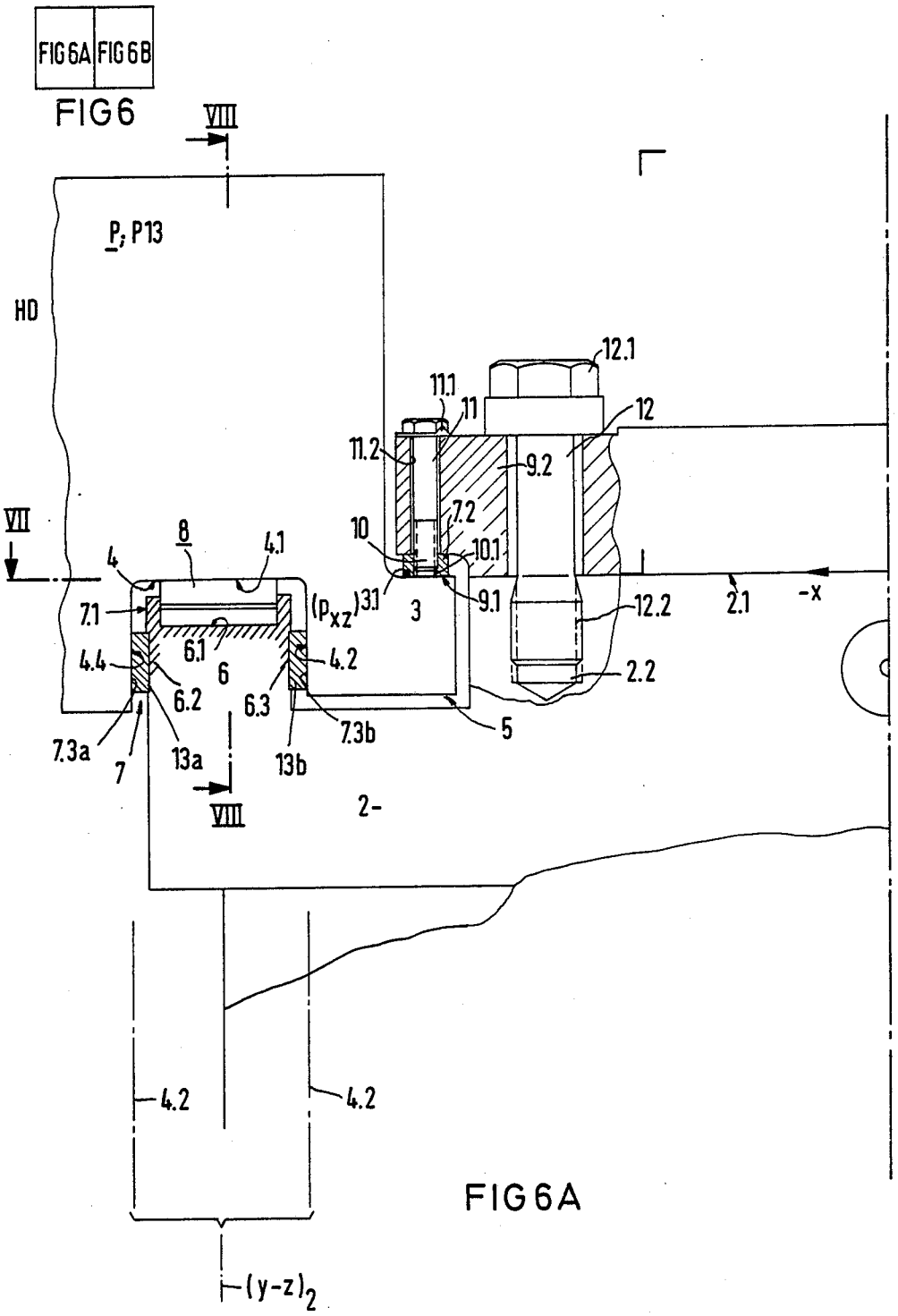
FIGS. 6A and 6B are an enlarged fragmentary view, partly in section of FIG. 3 as well as a sectional view taken along the line VI—VI in FIGS. 7A and 7B described hereinafter, showing a mounting arrangement according to the invention.
Figure 6B:
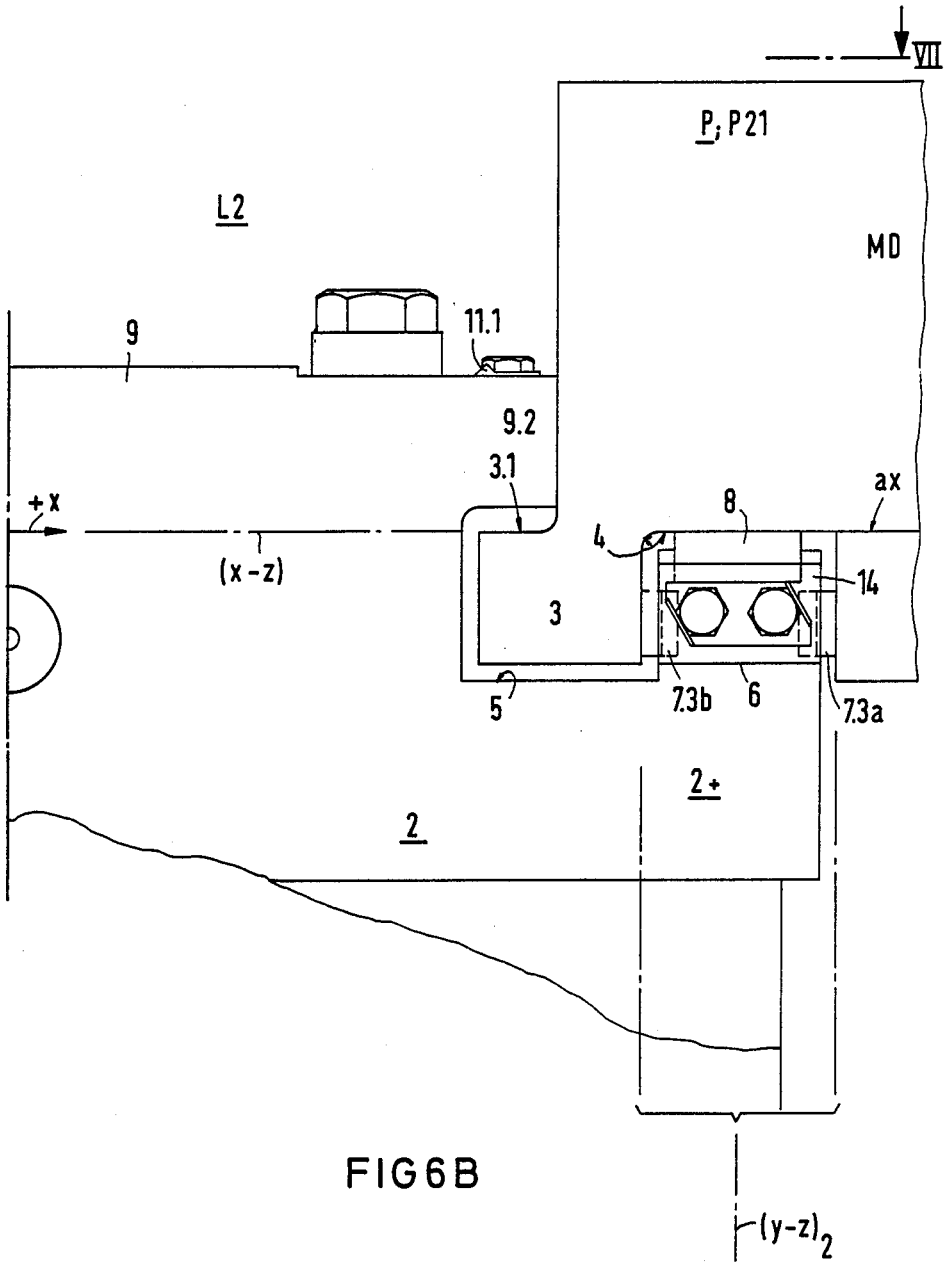

The fixed raised rims 6 of the support flanges 2 in conjunction with the inserted woodruff keys 13*a* and 13*b* thus provide fixed stops in the x direction for the side surfaces 4.2 of the support lug setback 4 whose reference planes normal to the axis are shown in phantom once more in FIGS. 6A and 6B and are summarily identified as the reference planes $(y\text{-}z)_1$ and $(y\text{-}z)_2$, respectively, already shown in FIGS. 2A and 2B. This forms the axial housing expansion fixed points for the housing G1 of the high-pressure turbine stage HD, the housing expansions of which in the directions −x and +x, respectively, start from these fixed points. Thus, the turbine mount L2 forms a double mount with four support lugs P13–P14 and P21–P22, respectively, which are supported in pairs and on both sides of the shaft center i.e. on both sides of the vertical axial plane x-y, on a respective double flange 2− and 2+ of the mount housing 2 (note FIG. 10), and of which the pair P13–P14 resting on the one axial end of the two double flanges belongs to the housing of the high-pressure turbine stage HD and the other support lug pair P21–P22 resting on the other axial end of the two double flanges belongs to the housing G2 of the axially adjacent medium-pressure turbine stage MD.

In agreement with the definition of the axial housing expansion fixed point between two adjacent turbine stages in general and between the illustrated high-pressure and medium-pressure turbine stages HD and MD, in particular, it is advantageous also to coordinate the definition of the axial shaft fixed point with the turbine mount L2, as shown in greater detail in FIGS. 10A and 10B in conjunction with FIG. 11. FIGS. 10A and 11 show the body 18 of the shaft mount L21, constructed as a rugged, axially split ring having two faces which accommodate the two rims 19*a*, 19*b* of the axial bearing blocks which rest against corresponding shaft collar surfaces 17*a* and 17*b* of the shaft 17, thus defining the axial shaft fixed point, or, more precisely, two fixed point planes normal to the axis. At the inner periphery of the mount body 18 which is rigidly joined to the mount housing 1 by means of a yoke 180 (FIG. 10A) there are located the slide surfaces 20 for the radial or journal bearing of the shaft 17 which have, in particular, a replaceable white metal casting insert. The surfaces of the shaft constriction in contact with the slide srfaces 20 are identified by reference character 17.1. Axially adjacent to the axial thrust bearing is a shaft coupling 21; the shaft bearing L21 and the coupling 21 are covered by a semicylindrical cover 22.

FIG. 10A shows fastened to the housing mount 1 in the direction −x towards the shaft bearing L21, a so-called axial sensor 22 having two probes 22.1 and 22.2 disposed opposite the two faces of a shaft collar 17.2 with a narrow gap therebetween. Inductive probes serving the control of the axial shaft position are involved, especially. Particularly clear from FIGS. 10A and 10B is also the axial centering of the turbine stage housings in the vertical axial plane x-y. Axially projecting in the direction of this plane x-y are rectangular guide spurs 23 (projecting in −x direction) and 24 (projecting in +x direction) which are disposed below the turbine shaft 17 on the end of the mount housing anchor plate 1.0 facing the respective turbine-stage face and engage the rectangular recess 26.0 of guide forks 26 of the respective turbine-stage face, leaving gaps 25.1 and 25.2, respectively, at the leg or flank and the face. The two fork legs are identified by reference characters 26*a* and 26*b*, and fitting pieces 27 locked in position thereof and serving for the alignment in axial shaft direction x are inserted in the flank or leg gaps 25.1. This makes it possible to achieve an exact adjustment of the turbine stage housings on the mount housings in the x direction and an exact axial centering during operation when the housings expand axially, the support and guide surfaces $m_{xy}$ (note FIG. 2A) appearing between the fitting pieces 27 and the inner flanks or sides of the fork legs 26*a* and 26*b*.

Figure 7A:
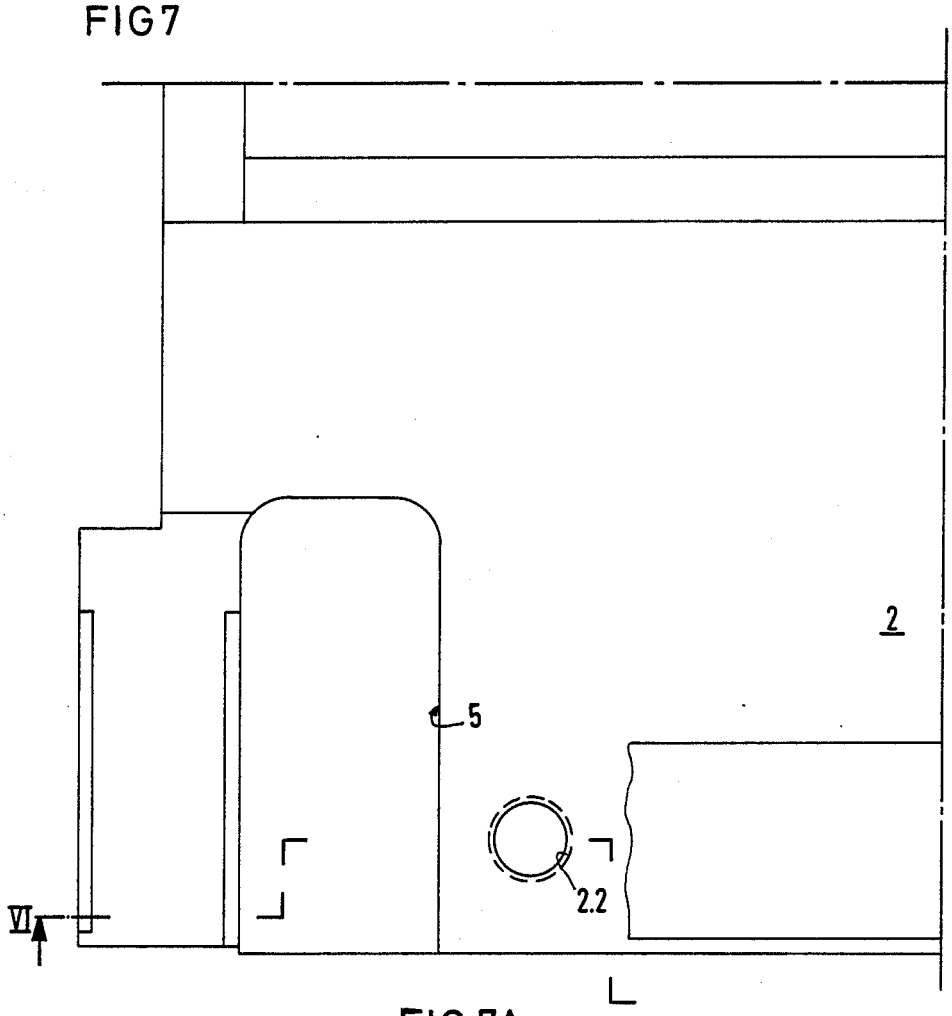
Figure 7B:
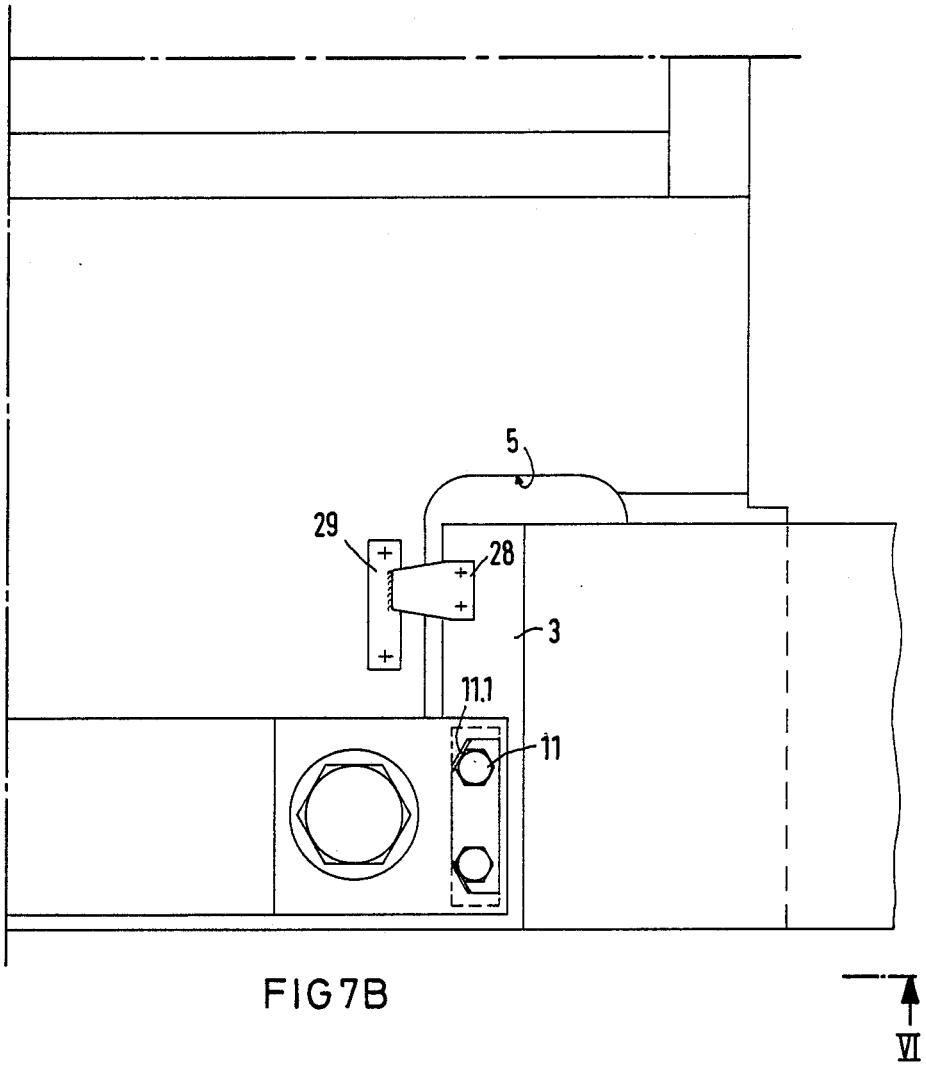

FIGS. 10A and 10B in conjunction with FIGS. 7A and 7B show another advantageous measuring arrangement in which there are fastened to an axially projecting extension 3 of the support lugs P, marks or pointers 28 with which there are associated scales 29 fastened in the margin area of the support flange 2 and serving to read the housing expansion in +z or −z direction. This makes it possible to check during operation the free, radially centrally thermally movable sliding motion of the support lugs along the turbine stage housing and, because this measuring arrangement 28, 29 is provided at all four support lugs of the turbine mount L2, it is also possible to determine whether there is a symmetrical thermal motion relative to the shaft center line x.

Figure 3:
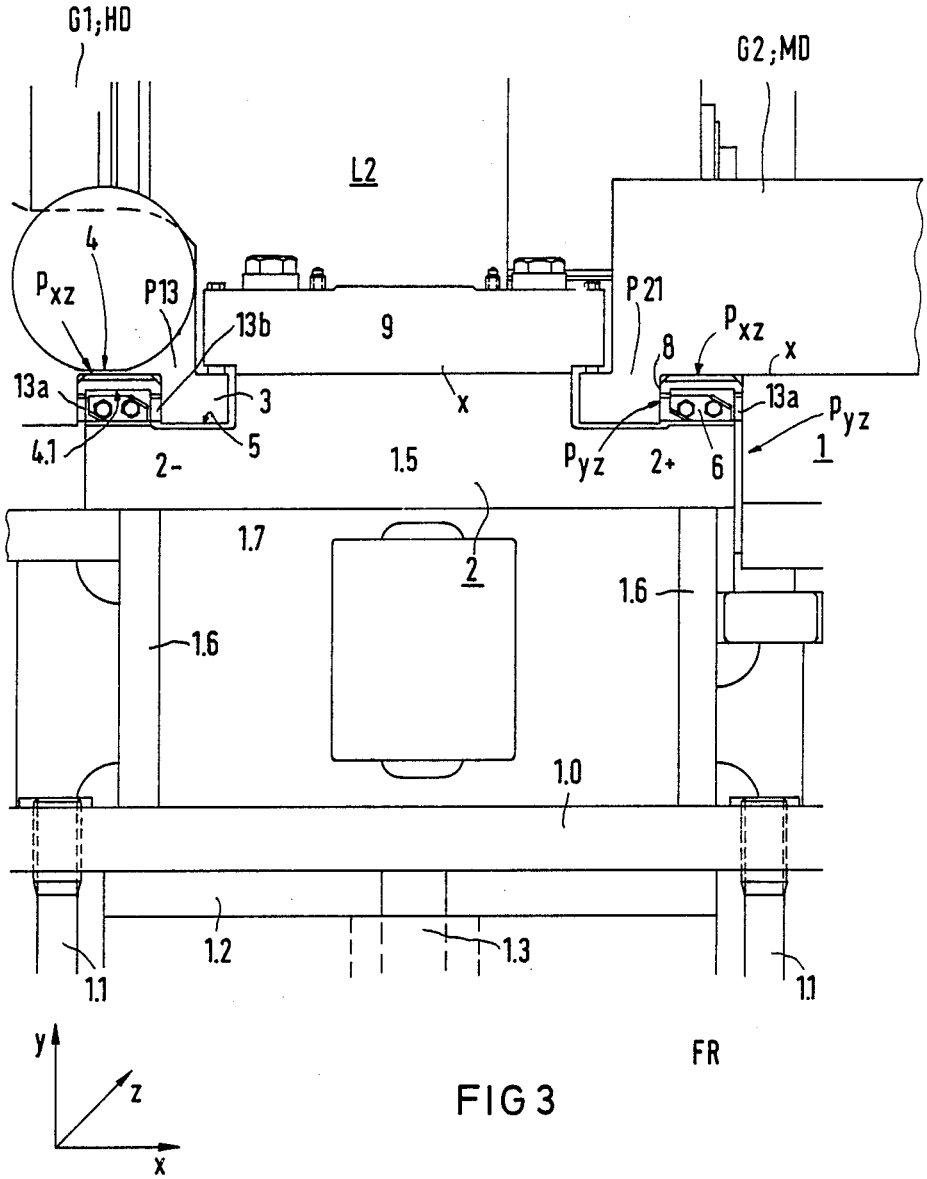
FIG. 3 is an enlarged elevational view of the detail III partly in FIG. 1A and partly in FIG. 1B and showing a housing mount between the high-pressure and medium-pressure turbine stages.
Figure 4:
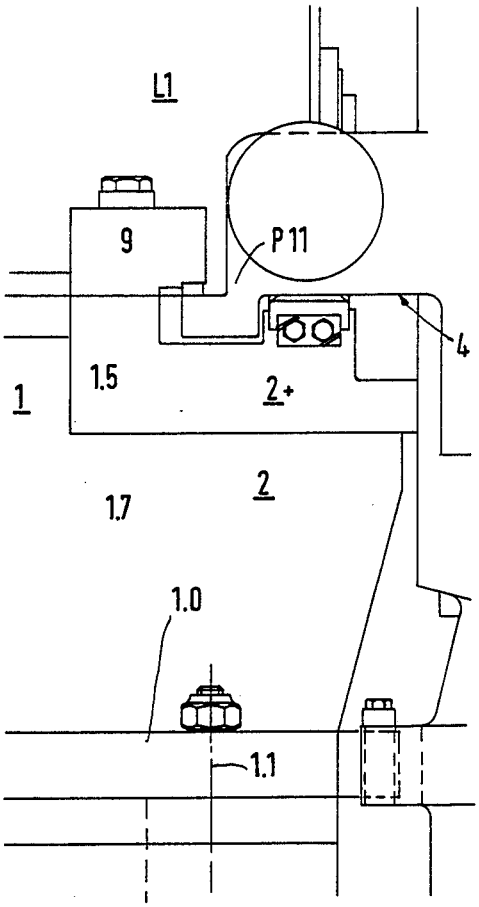
FIG. 4 is an enlarged elevational view of the detail IV illustrated in FIG. 1A and showing a housing mount of the high-pressure turbine stage.

In contrast to the turbine mount L2 according to FIG. 3, the turbine mount L1 according to FIG. 4 is constructed as a single mount with two support lugs P11 and (non-illustrated) P12 individually resting on a respective support flange 2 of the mount housing 1 on both sides of the shaft center x. This housing mount differs from that of FIG. 3 in that the woodruff keys 13*a* and 13*b* for defining the axial fixed points have been omitted in this embodiment so that the support lugs P can perform thermal sliding motions unhindered in −x direction, starting from the fixed point reference plane $(y\text{-}z)_1$.

Figure 5:
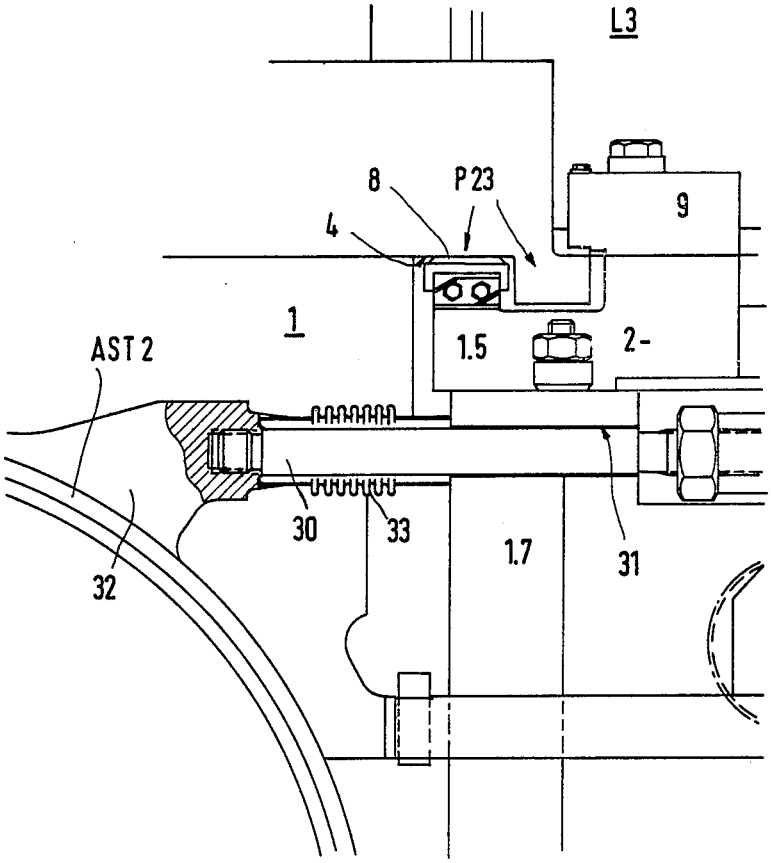
FIG. 5 is an enlarged elevational view of the detail V illustrated in FIG. 1B and showing a housing mount of the medium-pressure turbine stage at the low-pressure end thereof.

Analogously, this also applies to the turbine mount L3 shown in FIG. 5 (in which the shaft bearing is also not shown because it is not essential to the invention). This means that the setback 4 of the support lug does not serve for accommodating the woodruff keys; the respective support lugs P 23 and (non-illustrated) P 24 can expand unhindered with thermally movable sliding motion on the adjustment and slide shims 8 in the direction x, starting from the axially-normal reference plane $(y\text{-}z)_2$, this motion being guided by the axial centering means 23, 26, 27 as in the arrangement according to FIG. 4.

Furthermore, it may be seen from FIGS. 1A, 1B, 2A and 2B and particularly from FIG. 5 that the thermal motion of the housing G2 of the medium-pressure turbine stage MD transmissible via adjustable coupling rods 30 steamtightly passing through the mount housing of mount L3 in channels 31 to the inner housings of the otherwise non-illustrated low-pressure turbine stages having outer housings which can, therefore, be supported directly on the steam condensers by means of exhaust steam nipples or unions thereof, independently of the foundation locks FR and independently of the slab, respectively, so that the slab is relieved of weight in this respect. The coupling rods 30 are screwed into projections 32 of the exhaust steam nipple AST2, and this screw connection as well as the leadthrough through the mount housing on the other end are sealed by a corrugated tube compensator 33. The advantage of such an arrangement is that, starting from the axial fixed point reference planes of the turbine mounts L2, the medium-pressure turbine stage MD can expand in the +x direction and, adjacent thereto, the inner housings of the low-pressure turbine stages can expand in the same direction, resulting in very small blade plays with respect to the axial shaft expansion taking place in the +x direction, starting from the same turbine mount L2. The foregoing is a description corresponding, in substance, to German application P No. 35 22 917.9, dated June 27, 1985, International priority of which is being claimed for the instant application, and which is hereby made part of this application. Any material discrepancies between the foregoing specification and the specification cf the aforementioned corresponding German application are to be resolved in favor of the latter.

There is claimed:

1. Mounting arrangement for turbomachines, especially steam turbines having a plurality of coaxially juxtaposed turbine stages with shafts rigidly coupled to one another to form a shaft line, the turbine stages having turbine mounts including turbine shaft mounts and turbine housing mounts, the turbine mounts having respective mount housings mounted on foundation locks between the turbine stages and at the ends of the shaft line, the turbine stages having housings mounted at the ends thereof by means of support lugs symmetrically on both sides of the shaft so as to be axially and radially-centrically thermally movable as well as adjustable in x, y, and z direction in horizontal axial planes, and by means of axial centering guiding means in vertical axial planes, on and along the mount housings, respectively, or other foundation parts, the support lugs having support and guide surfaces and the axial centering means having guide surfaces extending in horizontal axial planes (x-z) and in vertical planes oriented plane-parallel to the vertical axial plane (x-y) and, for defining axial fixed points of thermal expansion of the housings, in planes (y-z) normal to the axis, respectively, the direction x being the axial shaft direction, z the horizontal direction transverse to the axis, and y the vertical coordinate running perpendicularly to the x-z plane, comprising respective step-shaped projections formed on the support lugs of the turbine stage housings and jutting axially outwardly and with a step-shaped upwardly offset setback axially inwardly adjacent said projections while forming a horizontal bottom surface serving as a support and guide surface; the respective mount housing having support flanges gripping under the support lugs at both sides of the shaft in accordance with the position of the support lugs, said support flanges having a depression for accommodating therein said step-shaped projection and having a stepshaped raised rim axially adjacent said stepshaped projection for engaging in said setback of said support lug; mutual engagement of said projection in said depression, and said raised rim in said setback providing clearance sufficient to form laterally accessible gaps; adjustment and slide shims insertable in the gap between a roof surface of said raised rim and a bottom surface of said setback for the purpose of slidable height positioning, said shims being securable in position thereof; said support lugs being secured against lifting forces and moments in a set height position by means of locks detachably fastened to a cover surface of said support flanges and engaging the stepshaped projections of the support lugs by means of lock projections having contact surfaces which are adjustable in height.

2. Mounting arrangement according to claim 1, wherein said bottom surface of said setback, and said cover surface of axial projection of the respective support lug are disposed in the same horizontal plane (x-z) and are adjustable to the level of the horizontal axial plane of the turbomachine by means of the adjustment and slide shims, and including sliding blocks secured in position thereof and bridging another gap, said sliding blocks being received in the gap between the underside of the respective lock projection and said cover surface of said axial projection.

3. Mounting arrangement according to claim 2, including setscrews passing through said lock projections and screwed from above into a blind tapped hole formed in said sliding blocks, set setscrews being secured against being unscrewed so as to secure the sliding blocks in position thereof.

4. Mounting arrangement according to claim 1, wherein, to define an axial, thermal-expansion fixed point in vicinity of the housing end of a turbine stage, slide and adjustment shims in the form of Woodruff keys are insertable from the side and securable in position thereof in the gaps formed between sides of said raised rim of the respective support flange, said sides pointing in the directions +x and −x, on the one hand, and the side surfaces of said setback of the respective support lug which are opposite thereto, on the other hand.

5. Mounting arrangement according to claim 1, wherein a single mount has two support lugs individually resting on a respective support flange of the mount housing on both sides of the shaft center.

6. Mounting arrangement according to claim 5, wherein said single mount is disposed at the outer end of a turbine stage, and said axial gaps are vacant so as to afford an axial sliding motion of the housing end.

7. Mounting arrangement according to claim 1, including a double mount with four support lugs resting in pairs on both sides of the shaft center on a respective double flange of the mount housing, the support lug pair resting on the one axial end of the two double flanges belonging to the housing of the one turbine stage, and the support lug pair resting on the other axial end of the two double flanges belonging to the housing of the axially adjacent turbine stage.

8. Mounting arrangement according to claim 7, wherein said double mount serves to define the axial heat expansion fixed points of the two turbine stage housings resting thereon and serves to accommodate a thrust bearing defining the axial shaft fixed point.

9. Mounting arrangement according to claim 8, with high-pressure, medium-pressure and at least one low-pressure turbine stage of an associated steam turbine, said double mount defining the axial heat expansion fixed point being disposed between the high-pressure turbine stage and the medium-pressure turbine stage.

10. Mounting arrangement according to claim 1, wherein said locks securing said support lugs against lifting forces are held against the respective support flange by strong anchor bolts.

11. Mounting arrangement according to claim 1, wherein, for centered guidance of the turbine stage housings in the vertical axial plane (x-y), axially projecting, rectangular guide spurs are disposed below the turbine shaft at the end of a mount housing base plate facing towards the end face of the turbine stage, said guide spurs engaging a rectangular cutout formed in guiding forks at said turbine end face, leaving gaps at the sides and end face thereof, the gaps at the sides being filled out by fitting parts secured in position thereof and serving to provide alignment in shaft axial direction.

12. Mounting arrangement according to claim 1, wherein measuring marks or indicators are fastened to the axially projecting projection of said support lugs and, in association therewith, a scale for reading the housing expansion in z direction, said scale being fastened in the margin area of the support flange.

* * * * *